United States Patent [19]

Seal

[11] Patent Number: 4,641,996

[45] Date of Patent: Feb. 10, 1987

[54] SIDE LOADING BOAT LIFTS

[76] Inventor: Morton Seal, Rte. 1, Box 483-C, Fort Myers, Fla. 33905

[21] Appl. No.: 652,265

[22] Filed: Sep. 20, 1984

[51] Int. Cl.[4] ..... B63C 3/04; B63C 3/08

[52] U.S. Cl. ..... 405/2; 405/3; 414/678; 187/14

[58] Field of Search ..... 405/1, 2, 3, 4, 7, 221; 114/44, 45, 48, 344, 366, 375; 104/127, 129; 187/12, 14, 95; 414/595, 678

[56] References Cited

U.S. PATENT DOCUMENTS

| | | | |
|---|---|---|---|
| 1,585,193 | 5/1926 | Haalck | 405/2 |
| 2,581,887 | 1/1952 | Saxton et al. | 187/14 |
| 2,829,781 | 4/1958 | Nomsen | 414/678 |
| 3,058,312 | 10/1962 | McDowell | 405/2 |
| 3,238,733 | 3/1966 | Kreis | 405/2 |
| 3,579,996 | 5/1971 | Edsor | 405/1 |
| 4,279,565 | 7/1981 | Verdy | 414/678 |
| 4,468,150 | 8/1984 | Price | 405/3 X |
| 4,482,268 | 11/1984 | Stevenson et al. | 405/3 |

FOREIGN PATENT DOCUMENTS

| | | | |
|---|---|---|---|
| 6611381 | 2/1968 | Netherlands | 114/48 |

*Primary Examiner*—Cornelius J. Husar
*Assistant Examiner*—Nancy J. Stodola
*Attorney, Agent, or Firm*—Alfred E. Wilson

[57] ABSTRACT

A boat lift mounted on a plurality of spaced masts secured in suitable foundations are provided to support an equal number of spaced rails extending angularly into the water to a depth below the draft of the boats to be elevated on the boat lift. A plurality of boat carriers slidably mounted on the rails have spaced rollers engaging the flanges of the rails to facilitate movement of the boat carriers relative to the rails. The boat carriers have horizontally extending extensions secured to their lower ends to underlie the boat which is chocked to hold it in an upright position on the boat carrier extensions as the boat is moved out of the water. A winch housing having a power actuated winch therein is provided to wind up a cable secured to the boat carrier to pull each of the carriers and the boat on the carrier extensions up the rails to elevate the boat out of the water. In boat lifts as heretofore constructed the cables extended over the top of the rails and down the front of the rails to engage the ends of the boat carriers to pull them up above the rails. These exposed cables posed a dangerous condition for anyone standing in the area of the boat lift, because if a cable broke it would fly with a terrific force, and if the cable struck anyone it would inflect very serious injury. With my improved boat lift I have succeeded in connecting the cables from the winches to the boat carriers beneath the rails, and therefore if a cable breaks the parties standing in the area of the boat lift are protected because the cable mechanism is nested beneath the top of the masts and the lower sides of the rails and therefore the cables are prevented from flying in an uncontrolled manner.

9 Claims, 8 Drawing Figures

SIDE LOADING BOAT LIFTS

BACKGROUND OF THE INVENTION

Various types of boat lifts have heretofore been devised to elevate boats out of the water for storage or to permit the hull to be checked or worked on. The most successful type of boat lift heretofore devised for pleasure size boats has been the side loading boat lift wherein a plurality of angularly extending rails project into the water at an angle and boat carriers slideably movable on the rails have horizontal extensions to project under the boat and the boat is supported in an upright position thereon. A plurality of masts secured in suitable foundations support the rails, and the boat is pulled up the rails. In units heretofore devised the cables extended over the top of the rails and are connected directly to the boat carriers slidably mounted on the rails. These constructions have been very dangerous because in the event of the breakage of a cable as occasionally happens, the cable being under considerable tension will fly and seriously injure anyone in the area. This has constituted a very serious problem in the development of commercially acceptable boat lifts.

FIELD OF THE INVENTION

The present invention overcomes the hazardous conditions heretofore existing by nesting the cables employed to elevate the boat beneath the junctures of the top of the masts and beneath the rails so that in the event a cable breaks it is confined by the metallic structure so that the danger of injury to anyone in the area of the boat lift is eliminated.

DESCRIPTION OF THE PRIOR ART

The major items of the prior art pertaining to the use of side loading boat lifts extend the cables used to elevate the boat up the rails to position the cables above the rails thus posing a hazardous structure for people who are in the area of the boat lift while it is in operation or while a boat is standing on the boat lift in an out-of-the-water condition.

SUMMARY OF THE INVENTION

This invention is directed to the rearrangement of the operating structure of side loading boat lifts in which the operating structure including the cables is shielded beneath the rails and the tops of the masts in such a manner that the cables are concealed and are safely disposed beneath the tops of the rails and the masts in a position where it is not hazardous to people who may be standing in the area of the boat lift.

DESCRIPTION OF THE PREFERRED EMBODIMENT

Figure 2:
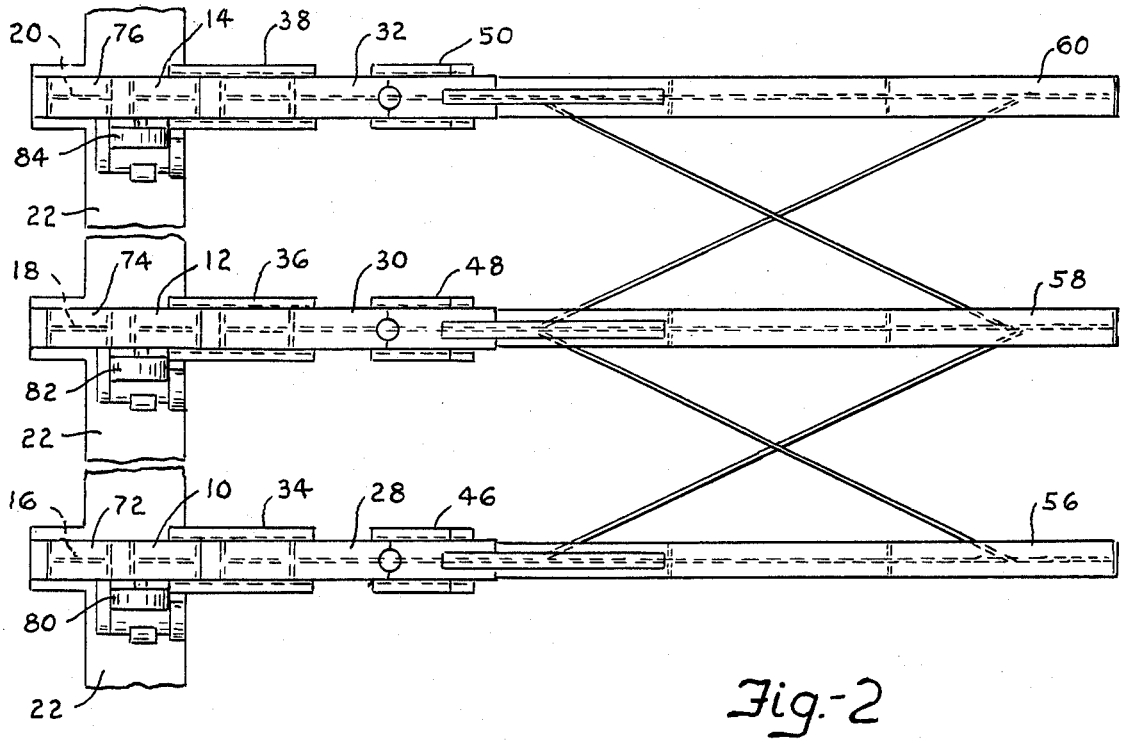
FIG. 2 is a plan view of the side loading boat lift.

Referring now to the drawings, a side loading boat lift is illustrated. A plurality of laterally spaced rails such as 10, 12 and 14 are mounted on suitable supports such as masts 16, 18 and 20 mounted on a seawall 22, piling 24 or other foundation. As will be noted the rails 10, 12 and 14 are spaced longitudinally of a boat 26 mounted thereon. If the boat lift is designed to accommodate relatively small boats, it will only be necessary to employ two spaced masts and rails, but if larger boats are to be accommodated, three rails 10, 12 and 14 are desirable. The rails are of such length and project at an appropriate angle, such as at approximately 45° angle so that the bottom ends of the rails 10, 12 and 14 extend into the water to a depth to accommodate the draft of any boat that is to be lifted on the boat lift.

The rails 10, 12 and 14 are preferably of I Beam or H Beam construction. Boat carriers 28, 30 and 32 are slidably mounted on the rails 10, 12 and 14, and have front yokes 34, 36 and 38 secured to the sides of the carriers and extending along the outer edges of the upper and lower flanges 40 and 42 of the rails 10, 12 and 14. The yokes 34, 36 and 38 extend below the lower flange 42 of the rails and a wheel 44 is rollingly mounted therein to engage the bottom of the rails to maintain the boat carriers 28, 30 and 32 slidably mounted on the rails. The rear or lower ends of the boat carriers are provided with yokes 46, 48 and 50 which support wheels 52 and 54 between the upper and lower flanges 40 and 42 of the rails 10, 12 and 14.

The boat carriers 28, 30 and 32 have horizontally extending extensions 56, 58 and 60 secured thereto as by welding to extend outwardly from the rails to underlie and support a boat which it is desired to elevate on the boat lift.

The keel or bottom of the boat rests on a suitable buffer 62 secured to the horizontal extensions 56, 58 and 60. Suitable chock brackets 64 and 66 carried by the horizontal extensions 56, 58 and 60 have angularly movable chocks 68 and 70 to engage the sides of the boat 26 to hold it in the upright position.

Winch housings 80, 82 and 84 are secured to the masts 16, 18 and 20 as illustrated to position the respective winches between the masts 16, 18 and 20 and the angularly disposed rails 10, 12 and 14. The cables 86 have one end 88 secured to a fitting 90 in a housing 91 secured to the masts 16, 18 and 20. The cables 86 extend downwardly beneath the respective rails 10, 12 and 14 and around the pulley 94 connected to the yokes 34, 36 and 38 of the carriers 28, 30 and 32 beneath the rails 10, 12 and 14 and up and around the pulley 96, and down to the drive drum or cable spool 98 of the power operated winch driven by an electric drive to wind up the cable 86 on a sheave to pull the carriers 28, 30 and 32 up their associated rails 10, 12 and 14 to elevate the boat out of the water. It will be understood that a block and tackle force multiplying device can be used if desired in instances where heavy boats are to be elevated.

An inherently strong structure is involved, and the construction is such that the dimensions of the structures can be increased as necessary to provide for the lifting of whatever sizes of boats which it is desired to elevate on the boat lifts.

Figure 1:
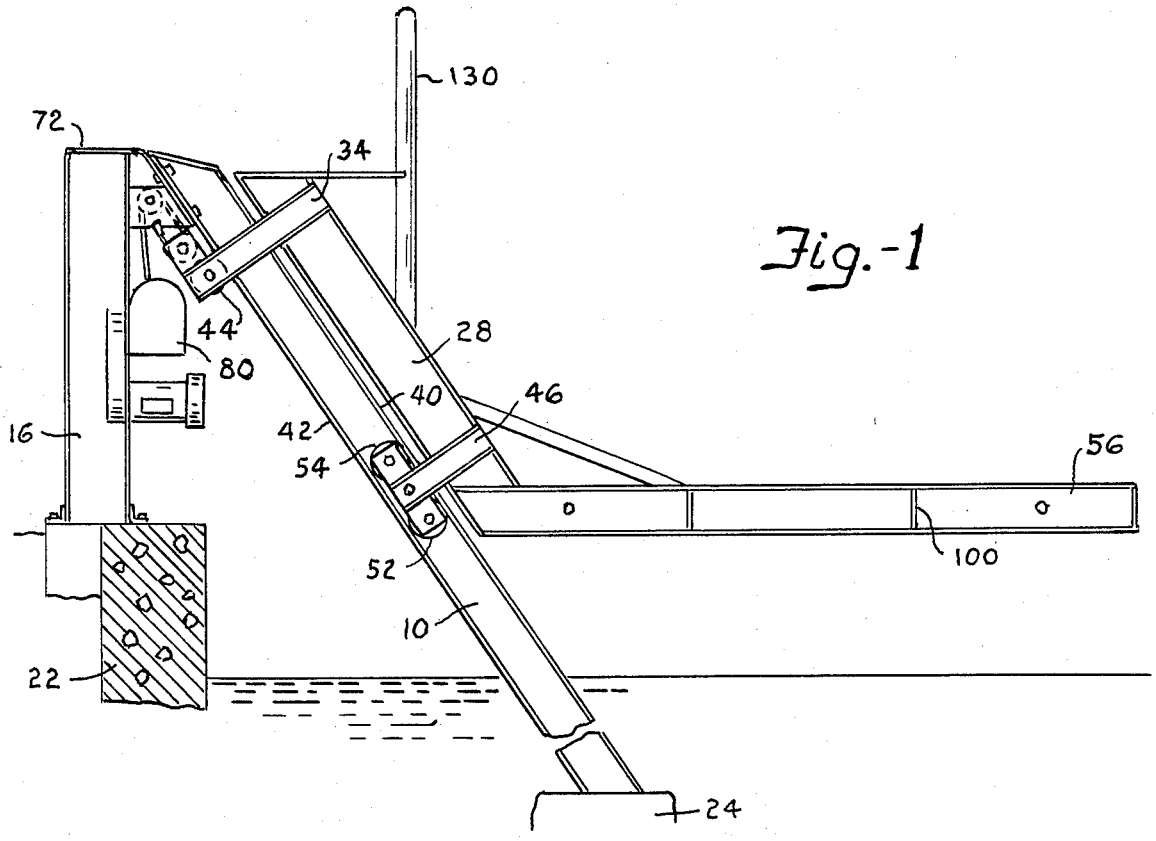
FIG. 1 is a side elevational view of a side loading boat lift embodying the present invention.
Figure 4:
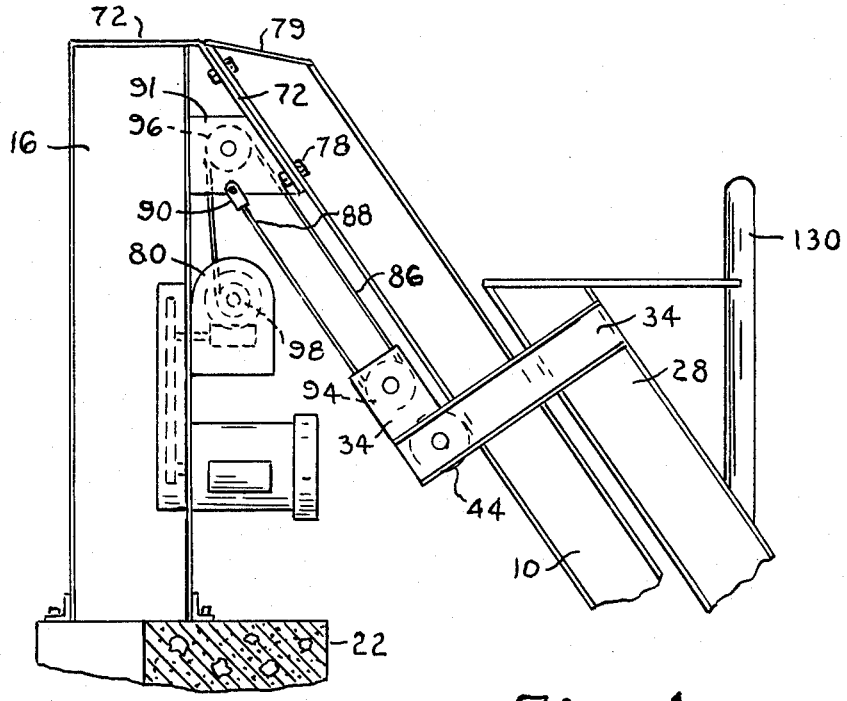
FIG. 4 is a fragmentary side elevational view of the juncture of the mast and rail members and showing the location of the power takeup winches.

The rails 10, 12 and 14 are securely fastened to the masts 16, 18 and 20 as illustrated in FIG. 4. Heavy plates 72, 74 and 76 overlie and are secured to the tops of the masts 16, 18 and 20, and the plates 72, 74 and 76 are angled downwardly at the rear or right hand end of the masts 16, 18 and 20 to align with and to be secured to the underside of the lower flanges 42, (FIG. 1) of the rails 10, 12 and 14. The tops of the rails 10, 12 and 14 are angled to extend horizontally and to align with the horizontal tops of the masts 16, 18 and 20, and as shown at FIGS. 1 and 4 the tops of the rails 10, 12 and 14 are closed by the plates 79 which align with the tops of the masts 16, 18 and 20. As illustrated in FIG. 4 abutments having housing portions 91 are heavy plates secured at one side to the masts 16, 18 and 20 and at the other side to the flanges 42 of the rails as shown in FIG. 1 to rigidify and strengthen the construction, and to establish the angular relation of the rails 10, 12 and 14 relative to the masts 16, 18 and 20. The rails 10, 12 and 14 are thus held firmly in the desired angular position. The rails are of sufficiently heavy gauge material, and have reinforcing and stiffening flanges to insure adequate strength to support the boats to be elevated by the boat lift.

The boat carriers 28, 30 and 32 are preferably of I or H channel shaped constructions, and may be of somewhat larger dimensions, and if desired of heavier gauge material to provide sufficient strength to adequately support the tension loads to which they are subjected, and to withstand the bending stresses that are imposed on them due to the horizontal extensions 56, 58 and 60 secured at an angle to each of the boat lift members.

The horizontal extensions 56, 58 and 60 are of I or H shaped members and preferably have reinforcing cross sectional gussets (100) cut to fit the open space between the flanges and the web of the channels. These reinforcing members are welded in place to reinforce and strengthen the boat supporting members and to add to the torsional resistance of the extensions.

Figure 3:
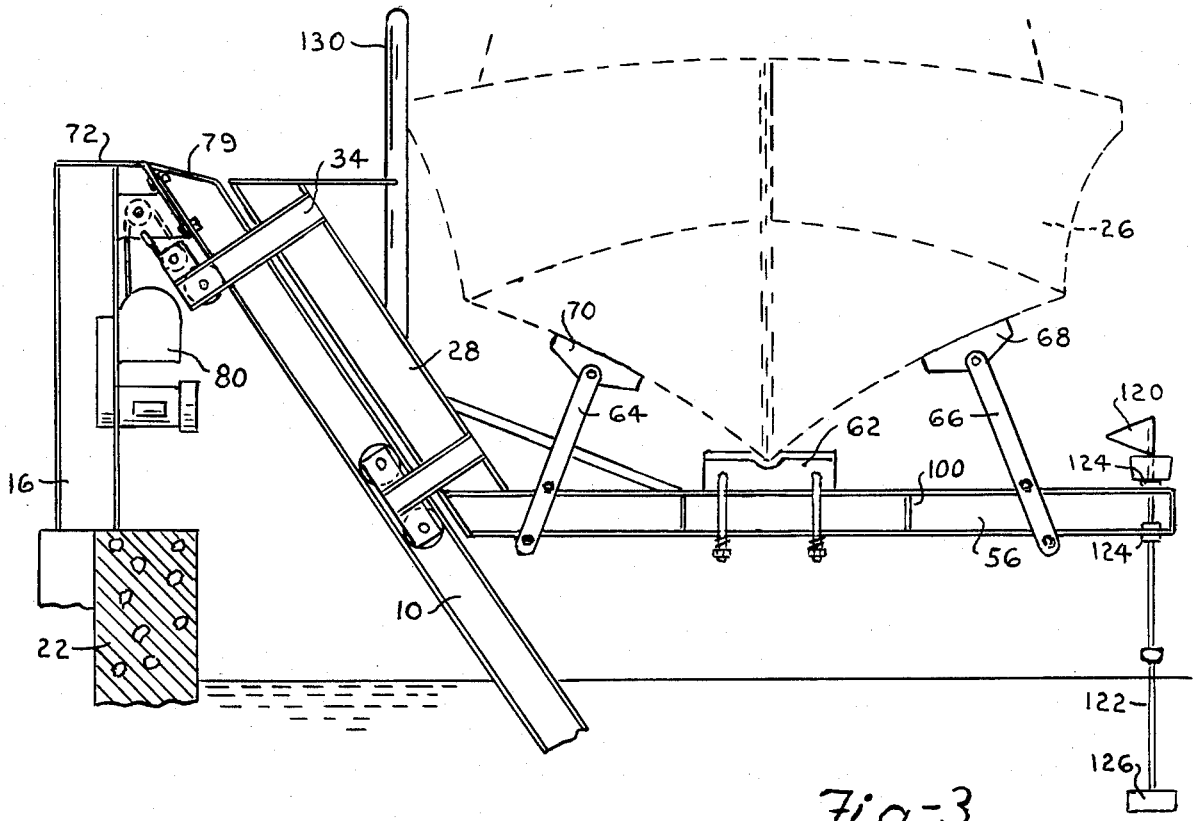
FIG. 3 is a side elevational view of one of the rails and one of the boat carrying members associated therewith and showing a boat in front elevational view on the boat lift.
Figure 6:
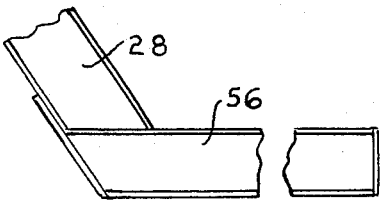
FIG. 6 is a fragmentary front elevational view of the boat carriers and the horizontal extensions on which the boat rests.
Figure 7:
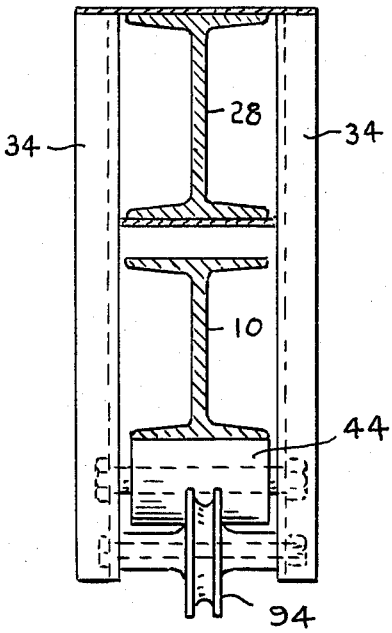
FIGS. 7 and 8 are sectional views of the control mechanism that is isolated beneath the tracks.
Figure 8:
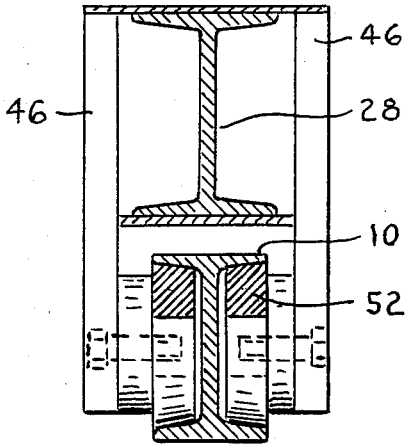

To further strengthen the juncture of the boat carriers 28, 30 and 32 to their associated horizontal extensions 56, 58 and 60 on which the boat rests, as shown in FIGS. 1 and 2 the cross-section of the carrier is butt welded to the outside flange of the extensions, and the extensions are capped cross-sectionally in such a way as to permit the cap to extend over the juncture with the carrier and in effect providing a so-called fish plate construction which materially adds to the strength and rigidity of the members. (FIGS. 3 and 6) Also the outer ends of the extensions 56, 58 and 60 are capped cross-sectionally to increase the torsional rigidity of the extensions.

Figure 5:
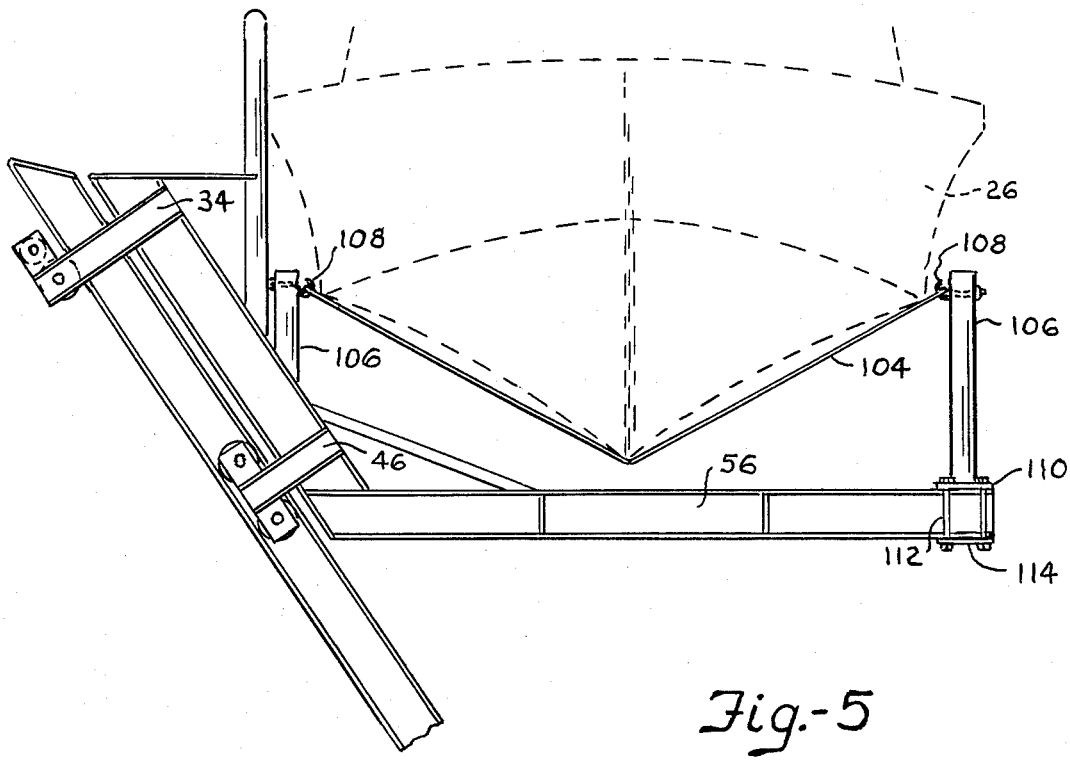
FIG. 5 is an elevational view illustrating an improved sling type boat supporting structure.

As shown in FIG. 5, slings 104 are employed to cradle the boat 26 between spaced sling masts 106 secured to the inner and outer end of the extensions 56, 58 ends 60 and a sling fitting 108 secured to the inner and outer sling masts 106 of the boat carriers 28, 30 and 32. The sling masts have lower base plates 110 adapted to receive bolts 112 projecting through apertures in the outer ends of the extensions 56, 58 and 60, and clamped thereto through a plate 114.

The slings 104 travel with the boat carriers 28, 30 and 32 and the extensions 56, 58 and 60. The slings have proven to be a more desirable way of supporting certain types of boats, particularly sail boats.

When the boat lift mechanism is submerged in the water buoys 120 secured to lines 122 passing through apertures 124 in the flanges of the horizontal extensions 56, 58 and 60 of the boat lift are held in position by weights or sinkers 126 to warn other boaters in the area that an obstruction is in the area beneath the water and to caution them not to encroach, or to do so with caution. Also, when the horizontal extensions 56, 58 and 60 are out of the water, the buoy 120 rests on the top of the extensions 56, 58 and 60 adjacent the apertures 124 to warn parties in the area of the presence of the boat carrying extensions.

The operation is as follows: The spaced horizontal extension members 56, 58 and 60 are controlled by a single actuating switch to cause them to move in unison so as to maintain a boat mounted thereon in a level aspect. If, due to the construction of the boat, it is desirable that the horizontal extensions 56, 58 and 60 be at a somewhat different elevation relative to each other to maintain a particular boat in a level aspect, the necessary adjustments are made by manipulating individual switches controlling the elevations of each of the boat carriers 28, 30 and 32 relative to each other.

When all is in readiness the boat 26 is maneuvered over the submerged horizontal extension 56, 58 and 60 to position the side of the boat adjacent the guide boat 130 to locate the keel of the boat over the buffer 62 carried by the boat supporting extensions 56, 58 and 60, or to position the boat between the sling mast 106 and the sling fitting 108.

When the boat slings 104 are not being used the chock brackets 64 and 66 are then adjusted laterally on the boat supporting extensions 56, 58 and 60 to position the chocks 68 and 70 in contact with the starboard and port sides of the boat to hold the boat in an upright position when the boat is elevated out of the water.

When all of the necessary adjustments have been made the master switch is actuated to elevate the boat carriers 28, 30 and 32 up the respective rails 10, 12 and 14.

Referring to FIG. 4, attention is directed to the fact that in the unlikely event that one of the cables 86, 88 or 90 should break, the cables are nested beneath the abutments in the form of heavy plates which overlie the tops of the masts 16, 18 and 20 and the angularly inclined plates, also marked 72 and secured to the flanges of the boat carriers 28, 30 and 32 by the bolts 78 and between the masts 16, 18 and 20 and the rails 10, 12 and 14 so that the broken cable is confined and is thus unable to strike a person standing in the area of the boat lift. When the boat is lifted out of the water to the desired height it is locked in place and is thus securely held.

To put the boat back into the water the position of the master switch is reversed whereupon the boat is lowered down the rails 10, 12 and 14 into the water.

I claim:

1. A side loading boat lift comprising a plurality of fixed longitudinally spaced masts, a cooperating rail fixed to each of the masts and extending at an angle into the water, a boat carrier slidably mounted on each of the rails, a horizontal boat supporting extension secured to each of the boat carriers to underlie and engage the keel of the boat to be lifted, a cable winch housing having a winch secured to each of the masts, a housing having a pulley interposed between each of the masts and its associated rail to rigidify the construction and to position the rails at a predetermined angular relation to the masts, a yoke having a pulley secured to the boat carriers and extending to the space between the masts and the rails, a cable fixed to the housing and extending over the pulleys journalled in the boat carrier yoke and the housing and extending to the winch to elevate and lower the boat carriers relative to the rails to elevate the boat out of the water or to lower it into the water.

2. The invention defined in claim 1 wherein the rails extend at an angle of approximately 45° to the masts and the abutments and the rails have angularly related flanges which when bolted together position the rails at approximately 45° relative to the masts.

3. The invention defined in claim 1 wherein the rails are of I beam construction having laterally extending flanges, upper and lower yokes secured to the boat carriers and extending on opposite sides of the rails, rollers carried by the lower yokes and positioned between the laterally extending flanges of the rails, and a roller carried by each of the upper yokes and rollingly engaging the lower surface of the rails.

4. The invention defined in claim 3 wherein the carrier has top and bottom flanges, and reinforcing plates secured to the top and bottom flanges of the carrier, and the upper and lower yokes extend on opposite sides of the carrier, and reinforcing plates secured to the top and bottom flanges of the carrier.

5. The invention defined in claim 3 wherein a winch housing is secured to each of the masts, and power operated cables positioned beneath the rails are connected to the upper yoke at points below the rails to move the boat carriers relative to the rails.

6. The invention defined in claim 5 wherein plates extend above the masts and rails to confine the cables in the event of a cable breakage.

7. The invention defined in claim 1 wherein the horizontal boat supporting extension members are rigidly secured to the boat carriers slidably mounted on the rails by butt welding the cross sections of the carriers to the outside flanges of the extending and positioning cap plates to extend over the juncture of the extensions to the carriers.

8. The invention defined in claim 1 wherein the boat carrying extensions are I beam shaped beam, and reinforcing gussets shaped to fit the open space between the flanges and the web of the I beam are welded in place to rigidify the boat carrying extensions.

9. The invention defined in claim 1 wherein the outer ends of the boat carrying extensions are apertured, and buoys adapted to float are secured to lines passing through the apertured outer ends of the extensions to float in the areas of the boat carrying extensions to warn other boaters that a submerged object is in the area, and weights secured to the lines hold the buoys in a floating condition closely adjacent to the outer ends of the boat carrying extensions and to position the buoy on the outer ends of the boat carrying extensions when the boat carrying extensions are out of the water.

* * * * *